United States Patent [19]

McMullan

[11] 4,293,763

[45] Oct. 6, 1981

[54] ELECTRICALLY INSULATED RESISTANCE HEATER

[76] Inventor: James P. McMullan, 12300 Monarch St., Garden Grove, Calif. 92641

[21] Appl. No.: 155,475

[22] Filed: Jun. 2, 1980

[51] Int. Cl.[3] ..... H05B 3/34

[52] U.S. Cl. ..... 219/528; 219/212; 219/530; 219/544; 219/549

[58] Field of Search ..... 219/527, 528, 529, 549, 219/211, 212, 217, 345, 530, 535, 536, 540, 544, 548, 552; 338/210, 212; 29/611; 126/256, 399

[56] References Cited

U.S. PATENT DOCUMENTS

| | | | |
|---|---|---|---|
| 1,820,602 | 8/1931 | Dick | 219/535 X |
| 3,102,186 | 8/1963 | Owers | 219/212 |
| 3,153,140 | 10/1964 | Theodore et al. | 219/549 |
| 3,191,005 | 6/1965 | Cox | 219/528 |
| 3,238,355 | 3/1966 | Van Ecck | 219/528 |
| 3,263,307 | 8/1966 | Lund et al. | 29/611 |
| 3,584,198 | 6/1971 | Doi et al. | 219/549 |
| 3,790,753 | 2/1974 | Miller | 219/528 |
| 4,139,763 | 2/1979 | McMullan et al. | 219/528 |
| 4,233,492 | 11/1980 | McMullan et al. | 219/217 |

*Primary Examiner*—Volodymyr Y. Mayewsky

[57] ABSTRACT

A thin, flat, multi-laminate resistance heater structure including a pair of spaced laminates of dielectric material with opposing inner surfaces, an elongate resistance element arranged between and extending throughout the major surface areas of said opposing surfaces, bonding material about the element and between the element and between the laminates and a filler in the bonding material comprising a multiplicity of strong dimensionally stable particulate components of a dielectric material having a lower dielectric constant than the bonding material.

6 Claims, 8 Drawing Figures

ELECTRICALLY INSULATED RESISTANCE HEATER

This invention has to do with improved electric insulating structures and is particularly concerned with a novel electric insulating cement for bonding laminates of a multi-laminate resistance heater together.

BACKGROUND OF THE INVENTION

In the art of resistance heaters, there are a considerable number of forms of resistance heaters which are established of laminates of conductive and dielectric materials bonded together by suitable cements.

The most common and well-known form of laminate heater of the general character referred to above are flexible or semi-flexible blanket-type heaters such as are used in combination with and between water bed frame platforms and flotation mattresses to temper or control the temperature of the water in the mattresses.

The ordinary blanket-type heater is a thin, flat, horizontal unit of rectangular or other desired plan configuration and includes a central elongate heater element of a suitable metal arranged in a zig-zag, serpentine or other suitable pattern throughout the major portion of the plane of the heater; thin, flat, top and bottom laminates of a suitable dielectric material, such as flexible polyvinylchloride sheet stock; and a flexible heat resistance cement about the element and between the laminates, securely bonding the several parts together in tight, sealed relationship with each other. In addition to the above, such heaters include electric coupling means to connect ends of the heater elements with the conductors of power supply cables extending from the heaters to suitable power sources.

The above noted type of heaters are most often operated on or powered with commercial alternating current.

The above noted type of heaters are intended to heat a related piece of work and are commonly arranged with the outer surface of one laminate in substantially uniform heat conducting contact with an opposing surface of the work. Still further, it is not uncommon that the heaters are held in contact with their related work by supporting or backup structures which establish substantial uniform heat conducting contact with the outer surfaces of the other laminates. When heaters of the character referred to above are arranged in contact with their related work and/or supporting structures and are energized with alternating current, the resulting combination and relationship of parts establish capacitor structures which function to cause notable current leakage.

For example, in the case of the typical blanket-type heater noted above, when the heater is arranged with its top and bottom surfaces in substantial uniform contact with and between opposing surfaces of a piece of related work and with a supporting structure, the heater element and the work establish the equivalents of the plates and the top laminate establishes the dielectric of a capacitor structure, while the heat element and the supporting structure establish the equivalent of the plates and the bottom laminate establishes the dielectric of a second capacitor structure. One or the other, or both, of the above noted capacitor structures induces and/or results in current leakage from the heater to the work and/or to supporting structure. The current leakage which occurs can vary widely and is dependent upon dielectric constant of the materials of which the laminates and cement are established, the thickness of those materials and resulting spacing of the capacitor plate-like parts of the construction and the conductivity of the work and/or the supporting structures.

In the case of the ordinary water bed which includes a lower bed frame with mattress supporting wood platform having low electric conductivity, an upper flotation mattress filled with a large volume of mineral-ladened water having high electric conductivity and between which the heater is arranged, the capacitor structure established by the capacitor plate-like mattress and heating element and the capacitor dielectric-like top laminate has far greater capacitance and results in far greater current leakage than does the capacitor structure established by the capacitor plate-like platform and heating element and the capacitor dielectric-like bottom laminate.

In order to limit and/or better control current leakage in blanket type heaters of the character referred to above, principal attention had been given to the dielectric constant of the materials used to establish the laminates and the thickness of those laminates. Notably less attention has been given to the cements that are used to bond the parts of such heaters together. As a rule, the cements used are selected from those commercially available cements which have suitable bonding, curing, heat resistive and elastic characteristics to meet the manufacturer's requirements and the cost of which is minimal.

In practice, the above noted cements are really fair conductors of electricity and the effects of their conductive characteristics are reduced to a minimum by using the cements sparingly; that is, by applying them in very thin, sparsely distributed layers or coats.

It has been determined that the dielectric constants of commercially available cements suitable for bonding the laminates or laminated blanket-type heaters together are oftentimes excessively high and that the fluid and/or plastic nature of those cements is such that the thickness and uniform or even distribution of those cements, between adjacent laminates of heater structures, cannot be effectively controlled. As a result of the foregoing, the capacitance of the capacitor structures defined by the heaters, when in use, is not uniform or predeterminable within desirable limits.

Tests conducted with heaters of the character referred to above show that most heaters have spots or portions where the cement is thick and the heaters have what can be termed low capacitance where little current leakage occurs; and have spots and/or portions where the cement has been substantially displaced during manufacture of the heaters and where capacitance and resulting current leakage is relatively high and oftentimes excessive.

As a result of the foregoing, I have determined that there existed a great need for a way and/or means whereby the electric conductivity and/or dielectric constant of the cements employed in the manufacture of laminated blanket-type heaters and similar electrical structures can be notably reduced; and a great need for a way and/or means whereby the thickness of such cements and the resulting spacing of parts bonded together thereby can be effectively controlled, whereby, for example, the capacitance of those structures can be made uniform and within predetermined, narrow limits.

OBJECTS AND FEATURES OF MY INVENTION

An object of my invention is to provide a novel cement suitable for bonding the laminates of a laminated blanket-type heater together, which cement has better electric insulating characteristics and a lower dielectric constant than those cements used in the prior art in the manufacture of such heaters and which is such that when it is applied to and between related parts of a heater structure, it can be easily and conveniently spread and caused to flow and establish a layer of cement of substantially uniform, predeterminable, desired thickness.

It is an object and feature of my invention to provide a laminated blanket type heater wherein the several laminates are bonded together by a deposit or layer of my novel cement, whereby the capacitance and resulting current leakage of the heater is lower and is more uniform throughout the plane of the heater than can be attained if the heater laminates were to be bonded together by any one of the commercially available cements commonly used by the prior art in the manufacture of laminated blanket type heaters.

It is another object and feature of my invention to provide a novel cement of the general character referred to above which includes a suitable adhesive having desired bonding characteristics and a filler of suitably shaped, structurally strong, particulate components which are less conductive and have a lower dielectric constant than the adhesive.

Yet another object and feature of my invention is to provide a cement of the character referred to above wherein the particulate components of the filler are those small substantially spherical or ovoid structurally strong vitreous material having gas-filled cavities and which are commonly referred to as "micro-balloons".

Another object and feature of my invention is to provide a cement of the general character referred to above wherein the particulate components of the filler are of predetermined size or sizes and are provided in predetermined number or volume so that they structurally support and slow or impede the free flow of the adhesive, before it sets and cures and are such that they establish bridging contact with each other and with the parts to be bonded together, whereby the parts are supported and held in substantial uniform spaced relationship with each other and a body or layer of cement of uniform, predeterimined thickness and capacitance is established therebetween.

It is an object and feature of my invention to provide a cement of the general character referred to above wherein the bridging structure of particulate components in the adhesive is a fluid structure and is such that it does not adversely affect the fluid nature of the cement when the cement is first applied and does not adversely affect the flexibility of the cement and of the finished product after the cement is set and/or cured.

Finally, it is an object and feature of my invention to provide an electrical structure comprising, in part, a mass of material having limited electric insulating characteristics and a filler of particulate components having greater electric insulating characteristics than the material disposed within the material whereby the insulating characteristics of the combined filler and material is greater than the insulating characteristics of the material alone.

The foregoing and other objects and features of my invention will be apparent and will be fully understood from the following detailed description of typically preferred forms and applications of my invention, throughout which description reference is made to the accompanying drawings.

DESCRIPTION OF THE DRAWINGS

FIG. 7 is a view of another embodiment of my invention; and

DETAILED DESCRIPTION OF THE INVENTION

In FIGS. 1 through 4 of the drawings, I have shown a typical, flexible, blanket-type resistance heater H embodying my invention. The heater H is a thin, flat, horizontal, rectangular unit including top and bottom laminates T and B, a central or intermediate laminate defining an elongate heating element E and a layer or deposit of cement C about and between the element E and the laminates T and B and bonding the parts together to establish an integral unit.

The laminates T and B are established of thin flexible sheets of uniform thickness and of a suitable insulating or dielectric material having an acceptable dielectric constant. For example, and in accordance with present day practices, the laminates T and B are established of polyvinylchloride sheet stock. The dielectric constant of different makes and qualities of polyvinylchloride sheet stock used in the building of heaters of the general character here concerned with varies considerably and may be as low as three (3) or as high as five (5); that is, such materials may have a dielectric constant which is from three to five times the dielectric constant of air when disposed between a pair of capacitor plates or equivalent conductor parts of a capacitor structure.

Figure 1:
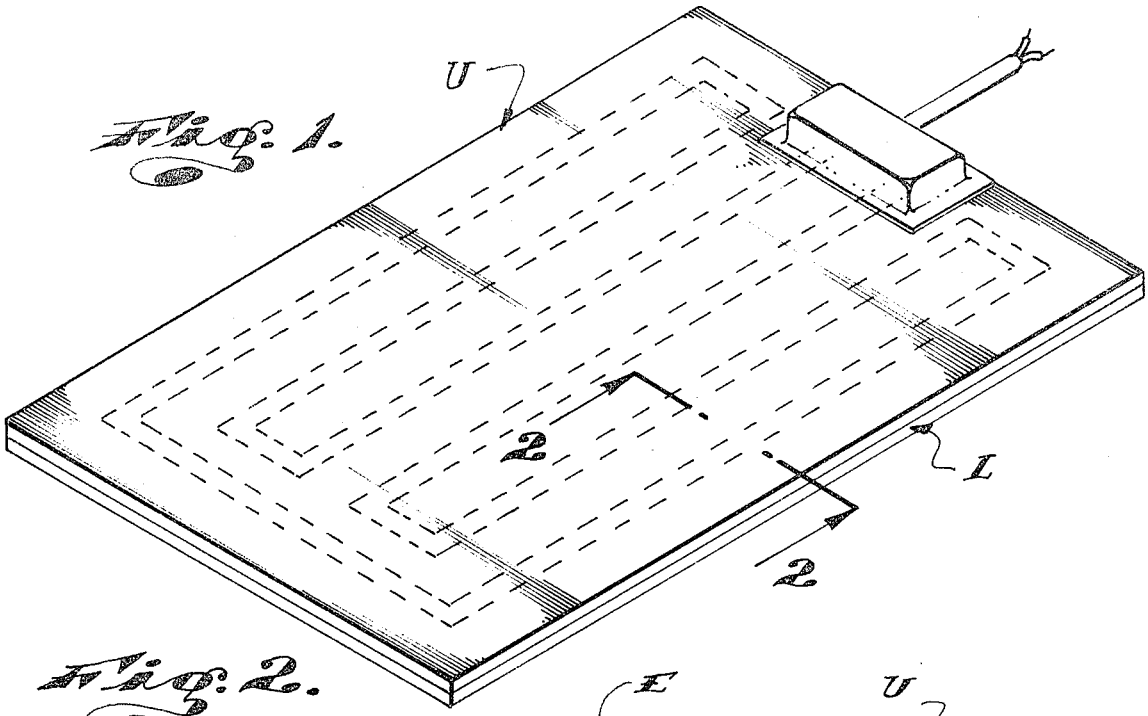
FIG. 1 is an isometric view of a heater embodying my invention.

The central laminate or resistance element E in the heater H can be established of an elongate metallic wire or a metal foil strip arranged in zig-zig, serpentine or other suitable pattern between the laminates T and B, and throughout the major portion of the horizontal plane of the heater H, substantially as shown in dotted lines in FIG. 1 of the drawings.

The elongate heater element E has opposite ends which establish terminals (not shown) at a junction J where they are suitably connected with the ends of related conductors of a power supply cable S extending away from the junction J to, for example, a suitable alternating current power supply, such as a domestic power service outlet (not shown).

Since the means at the junction J connecting the terminal ends of the heating element E to their related conductors of the cable S can vary widely without affecting or departing from the novelty of my inventon, I have elected not to unnecessarily burden this disclosure with detailed illustration and description of any one particular form of connecting or coupling means.

In the form of the invention illustrated, the laminates T and B have flat, top and bottom surfaces 10 and 11 and 10' and 11', respectively. The metal heating element E is shown as a flat ribbon-like foil strip having a flat top surface $10^2$ and a flat bottom surface $11^2$. The ribbon-like element is arranged with its bottom surface $11^2$ in close, opposing relationship with the top surface 10' of the bottom laminate B and is fixed thereto by a thin layer of deposit of a suitable flexible adhesive C' (see FIG. 3).

The above noted particular form and disposition of the heating element E and the inclusion of the deposit of adhesive C' between the element E and the bottom laminate B is the result of the process that I employ in the establishment of blanket-type heaters wherein the heating elements are established by cementing a sheet of metal foil on the top surface of a bottom laminate, the heating element to be established is printed on the foil with a masking paint or ink and the remaining or unwanted metal foil stock is removed by a suitable chemical etching process.

In practice, for example, if the element F was in the form of a simple flexible wire or if it was established of a sheet of metal suitably pierced and formed, the relationship of the element E with the laminate B might be notably different from that which I have elected to show and describe. Those differences which might occur are such that they do not adversely affect or result in any meaningful departure from the broader aspects and spirit of my invention.

The deposit or layer of cement C about and between the element E and the laminates T and B and which bonds the element and the laminates together, as an integral unit, includes a volume of adhesive A having suitable adhesive, heat resistant and electrical insulating characteristics, when it sets and is cured. Further, the adhesive A is such that before it sets and cures, it is suitably fluid and/or plastic to be conveniently flowed, spread and otherwise worked with and is such that when it sets and is cured, it is sufficiently flexible to allow for desired flexure of the finished heater structure H. When set and cured, the adhesive can remain somewhat plastic without adverse effects.

In practice, the adhesive A can be a normally fluid or paste-like aqueous or solvent based adhesive or a normally fluid thermal set adhesive which becomes substantially non-fluid but which remains flexible when set and cured.

One commercially available adhesive commonly used in the establishment or manufacture of heaters of the character here concerned with is a solvent based adhesive sold under the tradename Borden. This adhesive has those characteristics which makes it suitable for establishing heaters of the character referred to when following the teachings of the prior art. The electric conductivity or dielectric constant of the above noted adhesive and of similar commercially available adhesives is quite high and is such that prudence and good manufacturing practices requires that it be used very sparingly.

The above noted adhesive and other similar adhesives are such that if not used extremely sparingly and spaced very thin, they are subject to flowing and becoming unevently distributed about and between the element E and laminates T and B when the parts of the heater are assembled and worked upon, before the adhesive sets and cures.

The cement C that I provide, in addition to the adhesive A, noted above, includes a filler F of spherical, ovoid or other suitably shaped components M. The components M are preferably particulate substantially established of electrically insulative or non-conductive material having a dielectric constant which is notably lower than the dielectric constant of the adhesive A and such that when they are deposited in and distributed throughout the adhesive A in reasonable volume, they notably increase the insulative characteristics and reduce the dielectric constant of the cement (with respect to the insulative characteristics and dielectric constant of the adhesive alone).

In addition to the above, the components M of the filler F in the cement C are preferably structurally strong, dimensionally stable and provided in sufficient volume or quantity so that they establish supporting bridging contact with each other and with the parts of the heater structure adjacent thereto. Accordingly, the filler of particulate components slow and/or inhibit the free flow of the adhesive A between and relative to the parts of the heater and serve to prop or shore the parts of the heater in predetermined, substantially uniform, spaced relationship. With the parts of the heater thus supported, the deposit or layer of cement C is of substantial uniform thickness and has uniform capacitive effect throughout the plane of the heater structure H.

In the preferred carrying out of my invention, the particulate components M of the fillers F are small, hollow or cellular air or gas-filled bodies of non-conductive glass or equivalent vitreous material. The particulate components M are such that when brought into bridging contact with each other and between the spaced conductor parts in a capacitor-like structure, they have a dielectric constant which, while greater than air or gas within them, is less than the glass or vitreous material of which they are made.

In practice, the adhesive A is preferably sufficiently viscous and has sufficient surface tension and shear before it sets and cures, so that the particulate components M of the filler F are, for the most part, covered with a coating of the adhesive and notable volumes of the adhesive normally occurs between adjacent components B of the filler F when the components are in substantial bridging contact with each other and the cement is in a substantially dimensionally stable condition with and between the parts of the heater A.

Accordingly, the particulate components B of the filler F do not have to or tend to establish intimate contact with each other and with the related part of the heater structure when in substantial bridging relationship and do not tend to interfere or interrupt the integrity of the volume or mass of adhesive A going to make up the cement. As a result, the filler F does not adversely affect the adhesive characteristics, strength and/or flexibility of the adhesive A.

In practice, when the heater structure A is initially assembled, pressure can be applied thereto to properly orient the parts of the heater and cause the cement C to distribute uniformly. Such applied pressure may cause the components B of the filler F to establish intimate contact with each other. Thereafter, and before the cement sets and cures, the noted pressure is released permitting the adhesive A to flow back between and effect separation of the members M, as noted above.

In practice, a cement C, including a filler F of those particulate components commonly referred to as microballoons, ranging in size from less than one micron to as great as 1/64", and comprising less than one-half the total volume of the cement, has been found to be highly effective in carrying out my invention.

Figure 4:
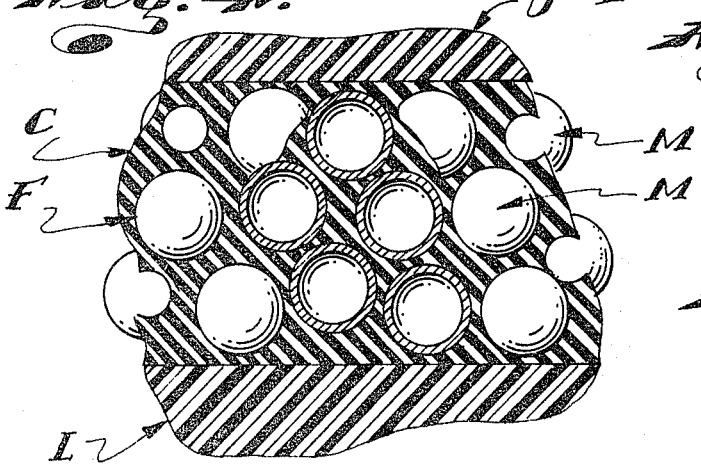
FIG. 4 is an enlarged detailed sectional view of a portion of the structure shown in FIG. 3.
Figure 6:
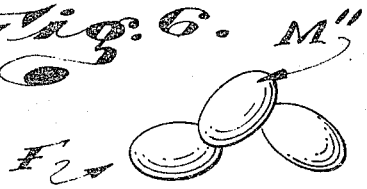
FIG. 6 is a view similar to FIG. 4 and shows yet another form of filler compound.
Figure 2:
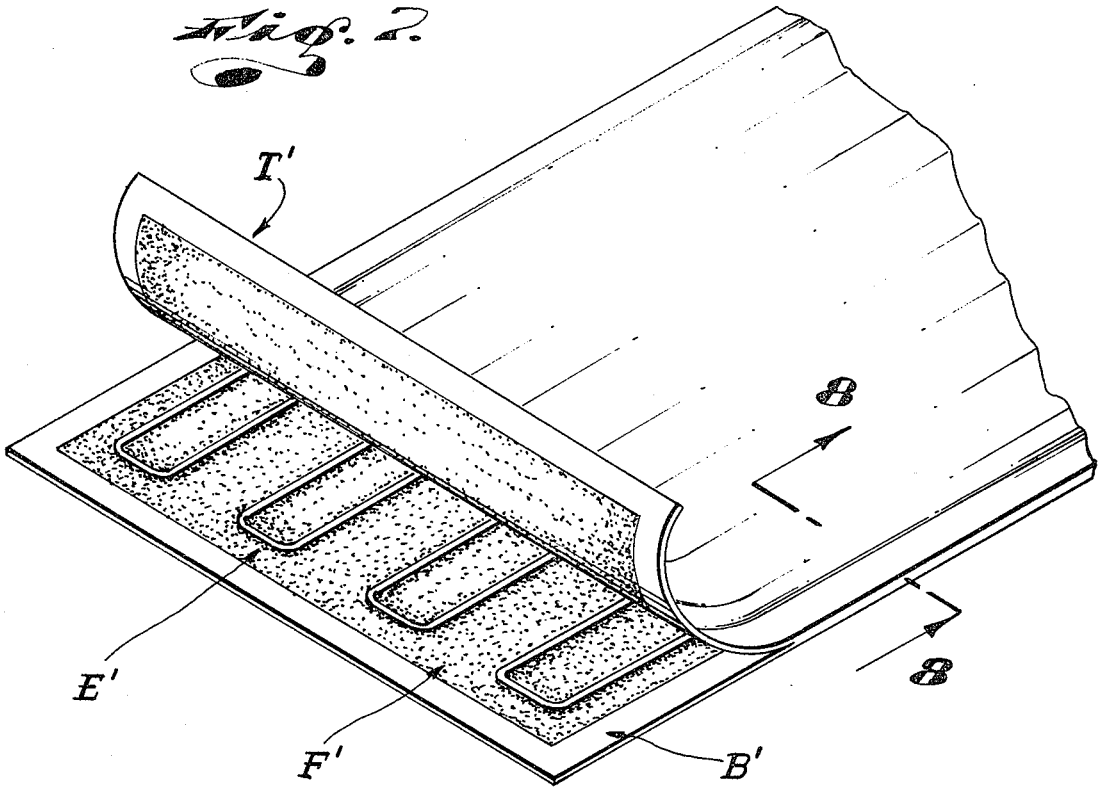

Referring to FIG. 4 of the drawings, the particulate components M are shown as hollow spherical components. In FIG. 6 of the drawings, the components $M^2$ are shown as being ovoid.

Figure 5:
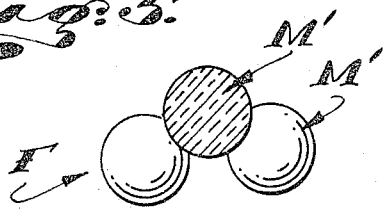
FIG. 5 is another form of filler component.

In practice, and as shown in FIG. 5 of the drawings, the components M' of the filler F' can be solid or can be characterized by multi-cellular centers without departing from the broader aspects and the spirit of my invention. In such cases, the filler material might be stronger but might have poorer insulating characteristics and a higher dielectric constant.

It is to be understood and it will be apparent that in practice, the particulate components of the filler need not be spherical or ovoid as shown in the drawings, but can be of any desired configuration which will afford a sound bridging structure and which will impart desired fluid characteristics into the unset cement and desired flexibility into the cement when it is set and cured.

With the heater construction described in the foregoing and shown in the drawings, it will be apparent that the layer of cement C has higher insulating characteristics and has a lower dielectric constant than the adhesive A (alone) and that the cement can be easily and conveniently applied more evenly and thicker than can the adhesive alone, whereby the capacitance which is established or results in the heater construction can be notably reduced and made to be uniform throughout the plane of the heater. That is, the heater is not subject to having thick and thin areas or spots where capacitance and attending current leakage is low or excessively high as a result of uneven distribution of cement.

Figure 2:
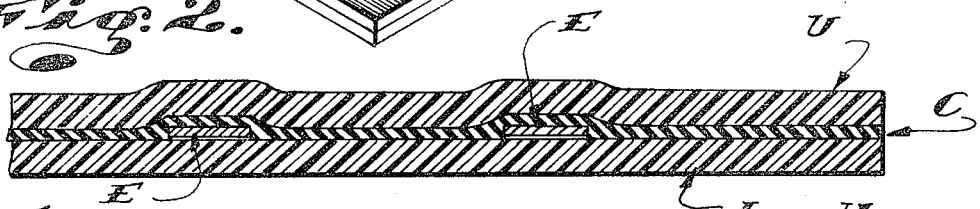
FIG. 2 is an enlarged transverse sectional view of a portion of the structure shown in FIG. 1; and taken as indicated by line 2—2 in FIG. 1.
Figure 3:
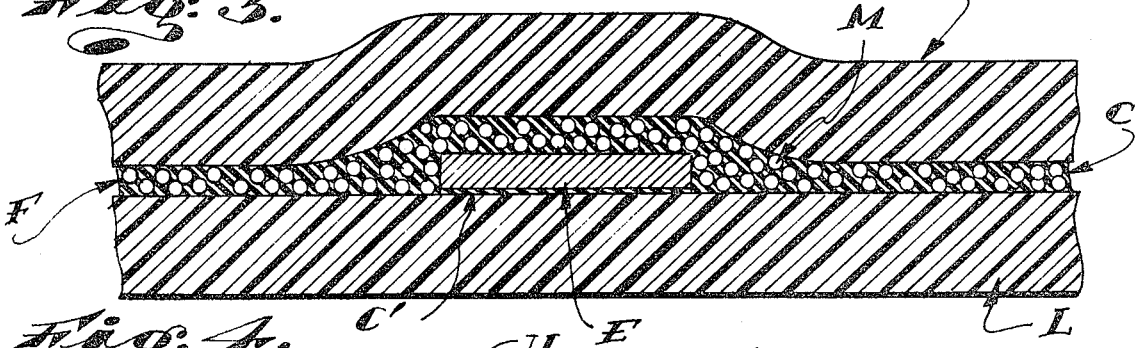
FIG. 3 is an enlarged detailed sectional view of a portion of the structure shown in FIG. 2.

In FIG. 2 of the drawings, the dotted lines L and L' above and below the top and bottom laminates T and B of the heater A indicate or define an element or piece of work related to the top of the heater H and a support or backup structure related to the bottom of the heater H. The work and the support structure both have a certain degree of conductivity, which might be quite high. Accordingly, the heater element E and the work L and the element E and the support structure L' define the spaced apart plates of capacitor structures in which the top and bottom laminates T and B and the cement C are the dielectrics. Both of the noted capacitor structures defined by the heater H and its related work and support structure cause current leakage and loss of efficiency in the heater H. The current leakage or loss of efficiency is proportional to the capacitance of the two noted capacitor structures.

The combined dielectric constants of the top laminate T and the thick uniform, highly insulative cement C, in combination with the capacitor plate defining element E of the heater and the capacitor plate defining work assures that the capacitance, resulting current leakage and loss of efficiency and through the capacitor structure defined by the element E, work and cement C will be notably lower and more uniform than could be attained if plain, unfilled adhesive was substituted for the cement C. By comparison, the capacitor structure defined by the element E, bottom laminate B and by the support structure L', has notably greater capacitance and might result in greater current leakage than the previously considered capacitor structure since the dielectric effect of the bottom laminate B is not supplemented by the presence of the thick uniform insulating cement C between the laminate B and the element E. In accordance with the above and in accordance with common practice, the lower support structure L' is or should be established of an insulating material having sufficiently low conductivity so that little capacitance and negligible current leakage will occur between the heaters and the structure L'.

In practice, if desired, the cement C can be made to occur between the laminate B and the element E, in the same manner that it occurs between the element E and the laminate T; in such a case the capacitance and potential current leakage of the capacitor structure defined by the element E, cement C, laminate B and support structure L' would be notably less.

In comparison tests of water bed heaters, wherein heaters made in accordance with the present invention were compared with similar heaters which were bonded together with common non-filled adhesive, the average current leakage in the heaters in embodying my invention was about 50 percent less than the average current leakage in the other heaters. Further, the current leakage which occurs in the heaters embodying my invention was determinable within narrow limits and was substantially uniform while the current leakage occurring in the other heaters was not predeterminable.

In the foregoing, I have described a laminated heater structure wherein top and bottom laminates are bonded together with a novel cement and with a resistance heating element engaged between them. In practice, another and an analagous form of laminated heater structure comprises top and bottom laminates of silicone rubber or the like bonded or vulcanized together by heat and pressure, with a resistive element arranged therebetween. In this form of heater, the rubber laminates are preferably initially uncured or only partially cured rubber compounds and constitute the equivalent of a plastic, though not fluid, adhesive, within the broader spirit of my invention.

Figure 8:
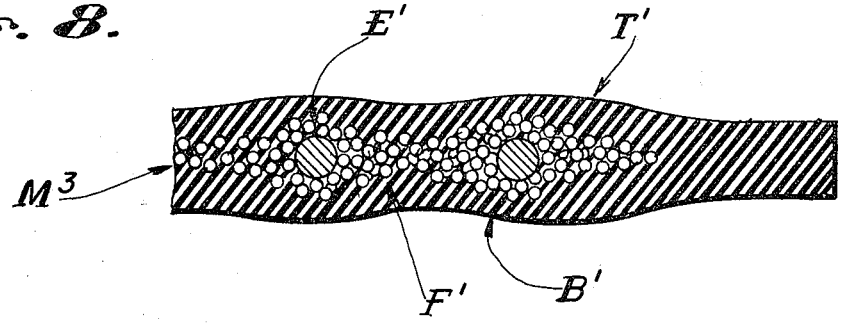
FIG. 8 is a sectional view taken substantially as indicated by line 8—8 on FIG. 7.

In FIGS. 7 and 8 of the drawings, I have shown a flat, laminated blanket-type heater comprising top and bottom laninates T' and B' of silicone rubber, an elongate resistive heating element E' in the form of a metal wire suitably arranged between the laminates T' and B' and a filler F' of dielectric particulate components $M^3$, such as provided in carrying out the first form of my invention, arranged about the element E' and between the laminates T' and B'.

The filler components $M^3$ are deposited on and throughout the inner opposing surfaces of the laminates T' and B' and about the element E' when the parts of the heater are initially assembled. Thereafter, the components M' are caused to move into and become imbedded within the mass of the rubber laminates when the assembly is compressed and heated to cause the rubber compound of the elements to flow and weld together or become vulcanized.

In the above, second form or embodiment of heater, it will be apparent that though the particulate components $M^3$ are not mixed into a separate adhesive to establish a cement which is applied to the heater laminates, the portions of the material of the heater laminates with which the components $M^3$ are initially related and which is caused to flow and commingle with the components when it is cured with heat and pressure is the equivalent of an adhesive within the broader spirit of this invention.

In furtherance of the above, it will be apparent that in practice, if desired, or if circumstances require a blanket-type heater of the general character referred to in the foregoing can be established by first applying a coating or layer of latex or equivalent adhesive on the inner opposing surfaces of the top and bottom laminates of the heater, depositing the dielectric filler components on the coated surfaces of the laminates, arranging the electric resistive heating element of the heater in desired manner between the laminates and then pressing the assembly together and causing the adhesive and the component coated opposing surfaces of the laminates to bond together.

In accordance with the above, it is not necessary that the adhesive and dielectric particulate filler components be pre-mixed. That is, the desired commingling of the adhesive and components can be effected in a step by step manner during the process of assembling and manufacture of the heater structure.

Having described only one typical form and application of my invention, I do not wish to be limited to the specific details herein set forth, but wish to reserve to myself any modifications and/or variations which might appear to those skilled in the art and which fall within the scope of the following claims:

Having described my invention, I claim:

1. An electrically insulated resistance heater comprising an elongate metallic resistance element, terminals at the ends of the element to connect said element in a power supply circuit for the heater, an electric insulating envelope structure comprising a pair of laminates of dielectric material having a low dielectric constant with inside portions between which said element is arranged and outside portions defining outer work-engaging surfaces in predetermined spaced relationship from said element and a multiplicity of particulate components of material having a high dielectric constant between the laminates in substantial bridging engagement with each other and with said element and enhancing the electric insulating capacity of the envelope structure and supporting the outside portions and work-engaging surfaces thereof spaced from the element, said laminates are joined together with the element and particulate components held secure therebetween.

2. The electrically insulated resistance heater set forth in claim 1 wherein the envelope structure is primarily composed of flexible polymeric plastics and said particulate components are composed of vitreous materials which are structurally stronger and dimensionally more stable than said plastics.

3. The electrically insulated resistance heater set forth in claim 2 wherein the particulate components have substantially smooth exterior surfaces.

4. The electrically insulated resistance heater set forth in claim 2 wherein the particulate components have substantially smooth exterior surfaces and have gas-filled inner cells.

5. The electrically insulated resistance heater set forth in claims 1, 2, 3, or 4 wherein said laminates are joined together by pressure and heat and are formed about and into holding engagement with the element and said particulate components.

6. The electrically insulated resistance heater set forth in claims 1, 2, 3 or 4 wherein the laminates are joined together and in holding engagement with the element and particulate components by a cement deposited between the laminates and about the element and the particulate components.

* * * * *